United States Patent [19]

Ledeuil

[11] Patent Number: 4,913,583

[45] Date of Patent: Apr. 3, 1990

[54] METHOD FOR WATERPROOFING A ROLLER COMPACTED CONCRETE OF RUBBLE

[76] Inventor: Didier Ledeuil, 20, Le Clos de l'Alizé, avenue d'Haïfa, 13008 Marseille, France

[21] Appl. No.: 370,524

[22] Filed: Jun. 23, 1989

Related U.S. Application Data

[63] Continuation of Ser. No. 54,686, May 27, 1987, abandoned.

[30] Foreign Application Priority Data

Jun. 3, 1986 [FR] France ..... 86 08086

[51] Int. Cl.[4] ..... E02B 3/16; E02B 7/00

[52] U.S. Cl. ..... 405/107; 52/169.14; 405/116

[58] Field of Search ..... 405/43, 45, 50, 107, 405/116, 117; 52/169.14

[56] References Cited

U.S. PATENT DOCUMENTS

| | | | |
|---|---|---|---|
| 1,879,430 | 9/1932 | Noetzli | 405/116 |
| 2,128,681 | 8/1938 | Logeman | 405/116 X |
| 3,680,319 | 8/1972 | Draper et al. | 405/116 |
| 4,090,363 | 5/1978 | List et al. | 405/109 |
| 4,525,960 | 7/1985 | Kelman | 52/169.14 |
| 4,659,252 | 4/1987 | Sexton | 405/109 |

FOREIGN PATENT DOCUMENTS

| | | |
|---|---|---|
| 2049240 | 4/1972 | Fed. Rep. of Germany . |
| 2221716 | 5/1972 | Fed. Rep. of Germany . |
| 2557292 | 3/1977 | Fed. Rep. of Germany . |
| 2734514 | 7/1977 | Fed. Rep. of Germany . |
| 2808304 | 9/1978 | Fed. Rep. of Germany . |

*Primary Examiner*—David H. Corbin

*Attorney, Agent, or Firm*—Browdy and Neimark

[57] ABSTRACT

The side of a hydraulic structure in contact with the water is covered with an impermeable membrane consisting of series of plastics so-called GEOSELLS which feature scales. These are interlocked with each other and then welded together edge to edge, and fixed to the structure by vertical fixings allowing movement of the GEOSELLS. This also favors drainage and initiation of microfissures regularly distributed in the structure. A granular coating is applied to the external surface at a raised temperature. This method is particularly suited to sealing granular rubble structures with or without binder. In rigid structures the binder may be a cement or a cement derivative, possibly a resin ("roller compacted concrete"). In flexible structures the binder may be a resin or a textile with or without reinforcing elements.

26 Claims, 6 Drawing Sheets

METHOD FOR WATERPROOFING A ROLLER COMPACTED CONCRETE OF RUBBLE

This application is a continuation of application Ser. No. 07/054/686,filed May 27, 1987 now abandoned.

BACKGROUND OF THE INVENTION

1. Field of the Invention

The present invention concerns a method for rendering waterproof a roller compacted concrete or rubble hydraulic structure steeply sloped on the upstream side (of the step wall type).

2. The Prior Art

For economic reasons hydraulic structures such as dams tend to be made nowadays of roller compacted concrete. The building of roller compacted concrete dams is the object of numerous publications and in particular of a communication of ACI Committee 207 published in ACI Journal (1980, July–August, pp. 215–235).

However, it appears that roller compacted concrete dams may show excessive permeability to water, especially at the interfaces between successive layers. In the long term this may lead to the cement in the concrete being attacked, especially where the water is chemically aggressive.

To remedy this disadvantage there have previously been proposed numerous ways to render the side of such structures in contact with the water impermeable.

One proposal (Concrete International 1964, May, p. 42, ENR 1983, 24 February, p. 35) is to cover this side with vertical prefabricated concrete members bolted into the core. The effectiveness of this technique is limited by the service life of the fixtures, however. It is also difficult to seal the joints when using this technique, especially the horizontal joints.

Another proposal (Highway & Heavy Construction, 1985, January, p. 39) is to cover this side with a layer of ordinary concrete. However, this concrete is subject to cracking which is accentuated by the absence of shrinkage joints. Given that it is relatively thin, this facing is also subjected to high gradient percolation which is all the more damaging where the water retained by the hydraulic structure is chemically aggressive.

It has also been proposed (Concrete International 1983, March, p. 21) to cover this side with stainless steel, but a solution of this kind is extremely costly.

Finally, it has been proposed to render the surface impermeable by applying to it a continuous reinforced butyl rubber membrane (ibid, FIG. 3). The manufacture, installation and securing of a continuous membrane of this kind raise serious problems and this solution has been proposed for illustrative purposes only.

SUMMARY OF THE INVENTION

There has now been developed an economical method of rendering waterproof the up-stream side of a structure of this kind being fitting onto this side an impermeable plastics material membrane.

The present invention consists in a method of rendering waterproof a hydraulic structure whereby an impermeable membrane is placed on the side of said structure adapted to be in contact with the water, in which method said membrane is made up from staggered series of thick plastics material with scales interlocked with each other and then welded together in a continuous way, fixed to the structure by vertical fixings and separated from said structure by a material enabling movement of said scales and initiating microfissures spread regularly through said structure. In this description the word. "GEOSELLS" will be used to designate a set of worked and assembled materials, the word "scale" being reserved for the up-stream side.

In a preferred embodiment of the method in accordance with the invention edge-to-edge welding of the scales may advantageously be complemented by welding on thick joint covers on the structure side.

The plastics material GEOSELLS may have any geometrical shape, a rectangular shape being preferred. For practical reasons concerned with manufacture, handling and installation, it is generally preferable for the rectangular shape scales to have a thickness from one through fifty millimeters, preferably from two through thirty millimeters, a width from two through eight meters, preferably from two through four meters, and a height from one through six meters, preferably from one through two meters.

The GEOSELLS may be made from any plastics material that is impermeable to water. However, it is preferable to make them from resins based on vinyl chloride and polyolefins. By resins based on vinyl chloride is meant polymers and copolymers containing at least 50% by weight of monomer units derived from vinyl chloride, polyvinyl chloride being preferred. By polyolefins is meant polymers and copolymers containing at least 50% by weight of monomer units derived from an olefin containing from two through eight atoms of carbon in each molecule, high-density polyethylene being preferred. It is to be understood that the material from which the GEOSELLS are made may contain the usual additives such as stabilizers and in particular anti-UV and reinforcing agents.

In the method in accordance with the invention it is advantageous to provide drainage behind the impermeable membrane consisting of the plastics material scales. The drainage system forms part of the GEOSELLS.

Drainage may be provided by vertical pipes disposed along the structure near the membrane and spaced from each other by between one and two meters, for example. These pipes may advantageously be formed when the scales are fixed vertically, as will be explained hereinafter. Each pipe preferably discharges individually into a collection tunnel, whereby any defective area can be precisely located.

In a preferred embodiment drainage is also provided by disposing a geotextile between the structure and the membrane. This geotextile advantageously covers the vertical fixings of the scales, which will be described later, and is included in the term "GEOSELL".

The geotextile fulfills three advantageous functions:

- separation of the membrane from the structure in the vertical direction;
- recovery of water or gas and its transportation to the pipes;
- elastic absorption of any impacts on the scales.

The geotextile is preferably attached locally to the membrane during construction; it separates the scales and the fixings, after backfilling, from the mass to be rendered waterproof and it serves to protect the drains during optional injection by virtue of use in double thickness.

The scales are fixed vertically in such a way as to allow the impermeable membrane to move vertically and to induce microfissures in the surface region of the structure in order to avoid the need to provide expansion joints by sawing into the roller compacted concrete structure.

In a preferred embodiment the scales are fixed vertically at intervals of one to two meters, for example, in such a way as to form at the same time vertical drainage pipes.

To this end, and in a first advantageous embodiment, vertical fixing is obtained by means of plates welded orthogonally and vertically to the side of the scales facing the structure, said plates being inserted into the structure and a drainage channel being provided at the level of the plates (plastic tube split longitudinally and fixed to the plate, perforated cylindrical member .welded to the plate, etc). The plates extend over all of the height of the scales and the superposed scales are fixed vertically in such a way that the channels constitute continuous vertical drainage pipes. This embodiment has the further advantage of favoring the initiation of the required microfissures in a uniformly distributed way.

The tubular members may advantageously be fitted over the generatrix opposite the orthogonal strips with members having a cutting edge, so as to favor the formation of microfissures, this blade also coming within the term "GEOSELL".

It is advantageous to provide at the level of the plates a tube providing for the injection of an area featuring defects. The width of the plate is generally from 100 through 500 millimeters and preferably from 200 through 400 millimeters.

The vertical fixings are preferably made from the same material as the scales, so as to favor their fitting onto the scales beforehand, as by welding, for example.

The geotextile disposed between the scales and the structure has to surround the vertical fixings with a thickness and according to a system (geotextile complex) that are identical in order to eliminate any risk of stress concentration as a result of compression due to the water or to impact.

The scales constituting the membrane are preferably held in place by horizontal fixings consisting of at least one lug welded horizontally facing towards the structure and forming an integral part of the GEOSELL, said lug being embedded in the structure and functioning in shear so as to take the weight of the GEOSELLS. As a general rule, the lugs are protected by the fixing tube, the latter then serving to stiffen the GEOSELL.

The side of the GEOSELLS in contact with the water may advantageously be protected by a layer of resin concrete (from thirty through sixty millimeters thick), in particular to strengthen their resistance to impact such as may be caused, for example, by floating bodies. According to an advantageous method, and where the constituent material allows it (as in the case of high-density polyethylene, for example), grit or tiles or even wood may be applied hot (followed by cooling), which favors the local fusion of the support, when partial incorporation results. Such integrated protection forms part of the GEOSELL and enhances it in terms of esthetics and in terms of protection against ultra violet radiation (U.V.).

When the membrane in accordance with the invention is fabricated the GEOSELLS are fitted in successive layers as the structure is built up, and may advantageously serve as non-reusable shuttering. The GEOSELLS are preferably disposed as climbing shuttering type supports fixed into the structure through the GEOSELLS lower down already fitted, with the aid of expansion tools referred to herein as "GEOTOOLS". These tools, as used in this advantageous process, are not commercially available. They are expansion type tools and are inserted into each GEOSELL tube, favoring blocking and centering and finally enabling adjustment of the positioning of the new GEOSELL and thus creating the waterproof structure that is the subject matter of the present invention.

To enable continuous fitting of the scales and continuous placement of the embanked roller compacted concrete, it is possible either to backfill area by area, terminating in slanted layers, or to backfill continuously but with a slight slope. The interfaces between layers are no longer a significant problem once the up-stream side is scaled with a mask that has a huge associated drainage capacity. This is one particularly strong advantage associated with the new process. The interfaces will therefore have a mechanical character (possible random steps) rather than the usually required continuity and sealing function.

BRIEF DESCRIPTION OF THE DRAWINGS

The method in accordance with the invention will now be described by way of illustrative example only with reference to the appended diagrammatic drawings, in which.

DETAILED DESCRIPTION OF THE PREFERRED EMBODIMENT

Figure 1:
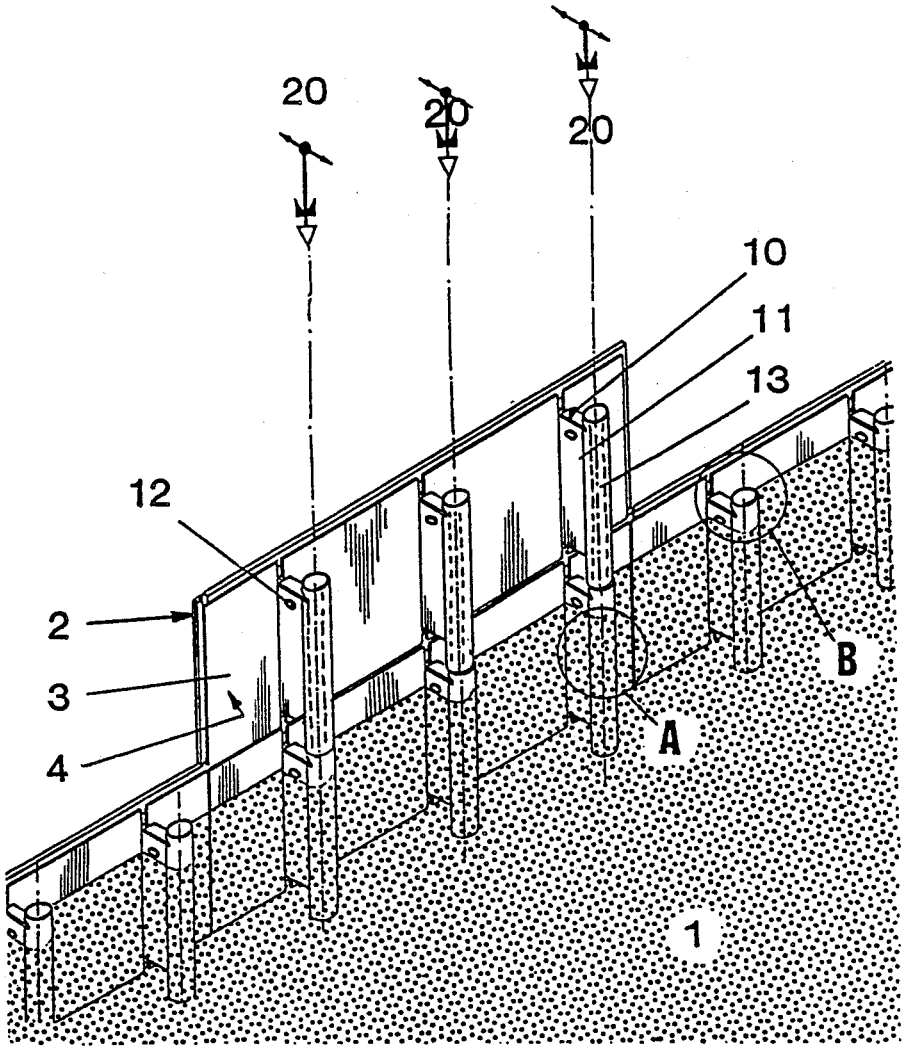
FIG. 1 is a partial view in perspective of a roller compacted concrete structure fitted with an impermeable membrane constructed according to the method in accordance with the invention, assembled on a multiplate basis by high-frequency welding or induction heating, with incorporated metal or PVC grid, or by any other welding process or even by adhesive bonding, depending on the constituent materials.
Figure 2:
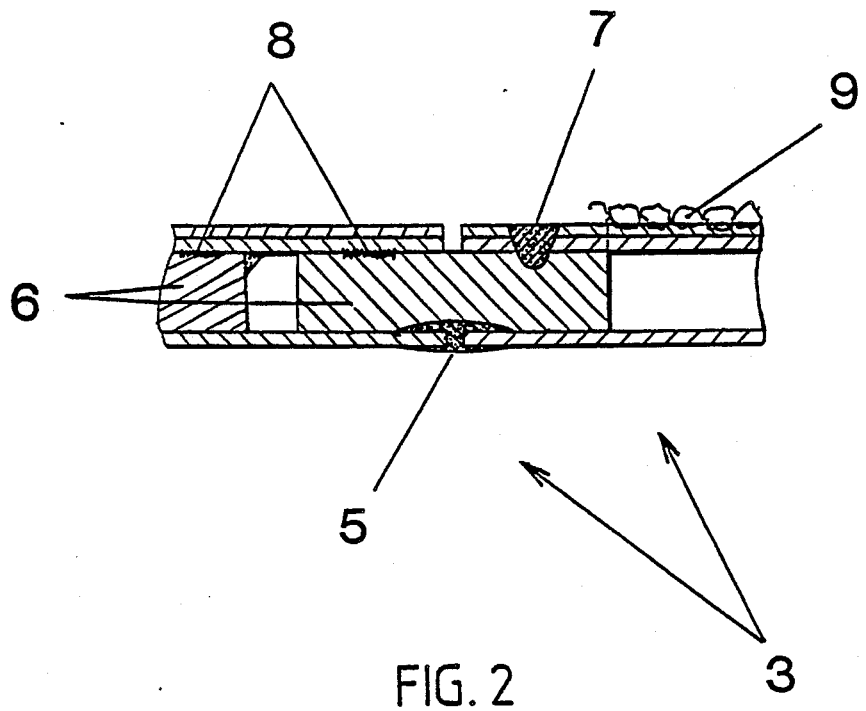
FIG. 2 enlarged view of the area marked A in FIG. 1.
Figure 3:
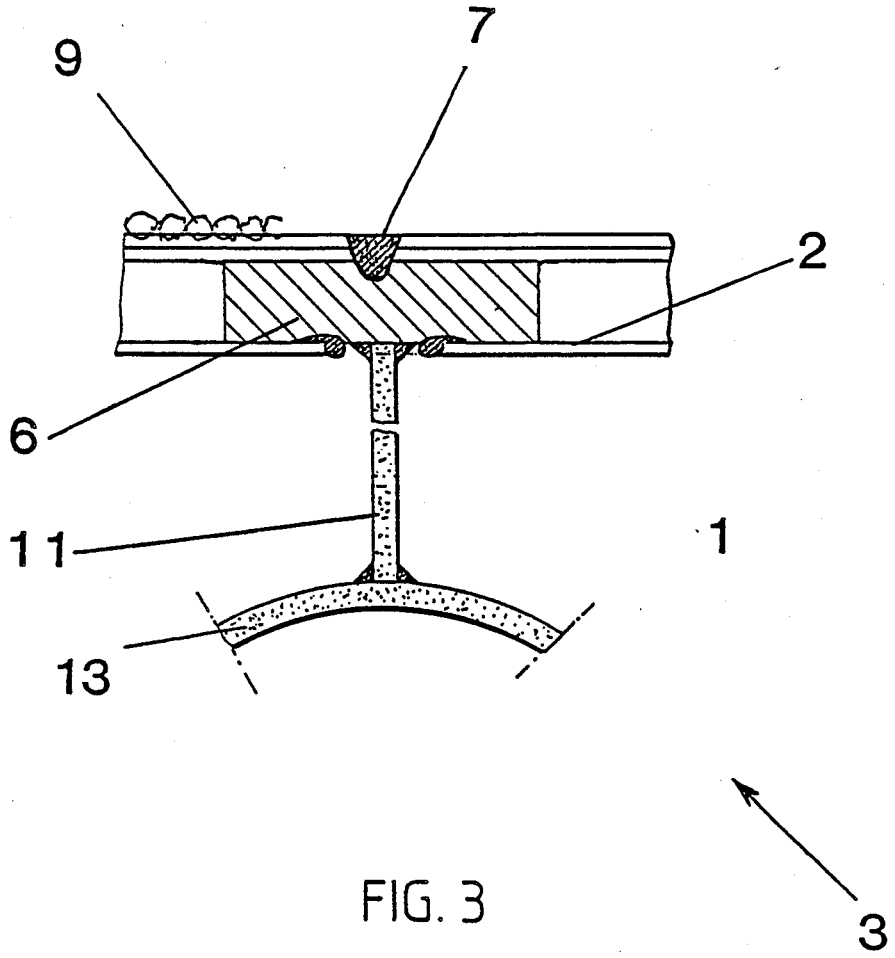
FIG. 3 an enlarged view of the area marked B in FIG. 1.

As is seen in FIG. 1, the roller compacted concrete structure 1 is covered on the side in contact with the water by an impermeable membrane 2 consisting of series of plastics material GEOSELLS, with a geotextile interlayer 4. As shown in FIG. 2 in particular, the GEOSELLS are fixed together by continuous welds 5 on thick joint covers 6 welded off-site either by penetrating heat spot welds 7 or by high-frequency welding to heat a metal or PVC inclusion 8.

Still with reference to FIG. 2, grit inclusions 9 can be seen. The GEOSELLS are fixed horizontally by stiffener lugs 10 at the top of flanges 11 formed with fixing holes 12 and attaching the tube 13 to the membrane 2.

Figure 4:
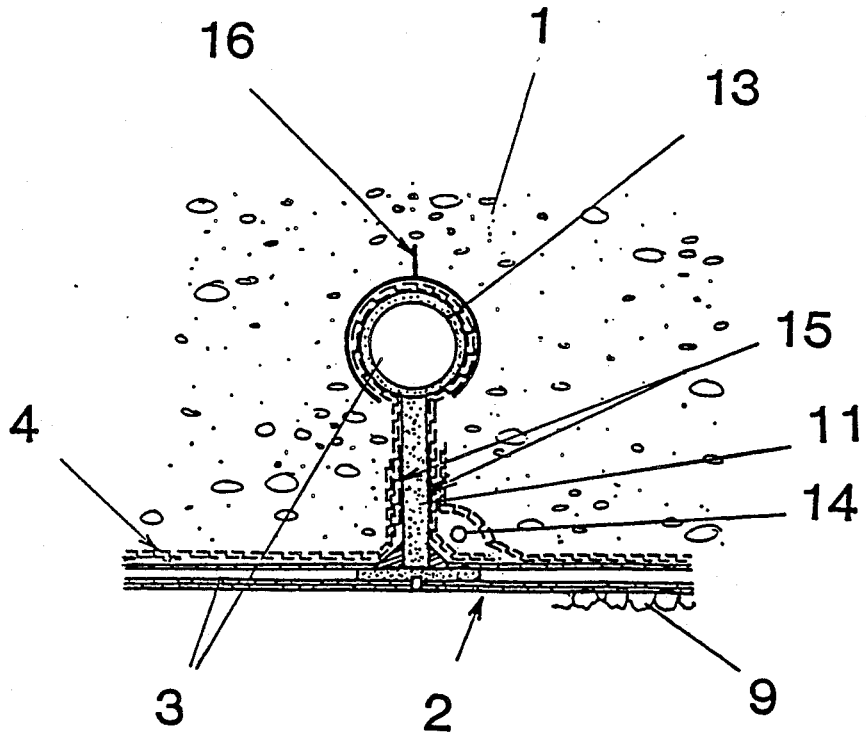
FIG. 4 is an overall implementation view for the area marked B in FIG. 1.

A sleeved tube for optional injection may be placed at 14 and benefit from a double thickness coating 15 of the geotextile 4. In one embodiment shown in FIGS. 1 and 4 the GEOSELLS 3 are fixed vertically by tubular members 13 providing drainage and fixed vertically to the scales 2 by strips 11 orthogonal to the scales 2. The scales 2, the strips 11 and the tubular members 13 are welded together. The tubular members 13 and the strips 11 are inserted into the structure 1 as it is built up. The geotextile 4 completely surrounds the vertical fixings so as to provide partial separation between the structure 1 and the membrane constituted by the scales 2. Profiles with a cutting edge 16 are clipped over the edges of the vertical fixings surrounded by the geotextile 4. As the successive GEOSELLS are applied, it is also necessary to align the tubular members 13 between the superposed GEOSELLS so as to constitute vertical drainage pipes.

Figure 5A:
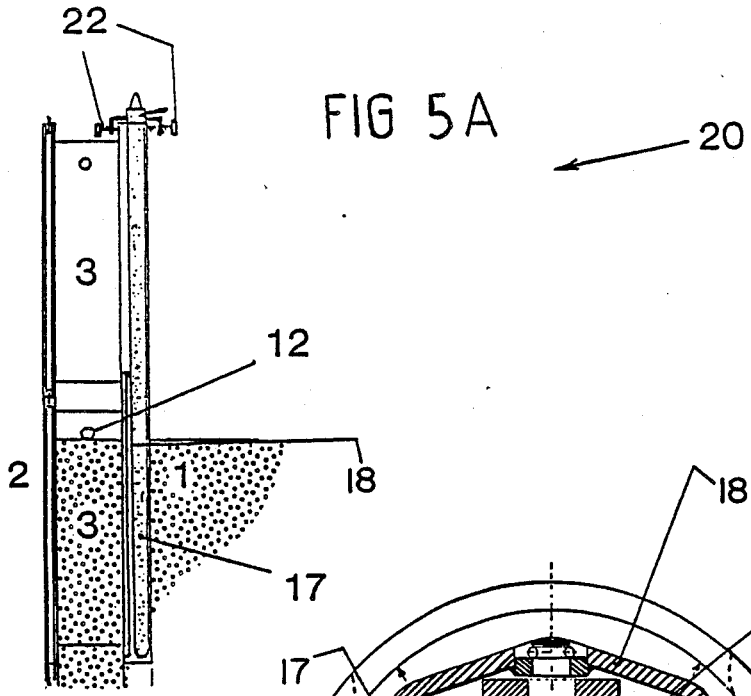
FIGS. 5*a* and *b* are schematic view of the "GEOTOOL" including a horizontal cross-section through the expansion cam system.
Figure 5B:
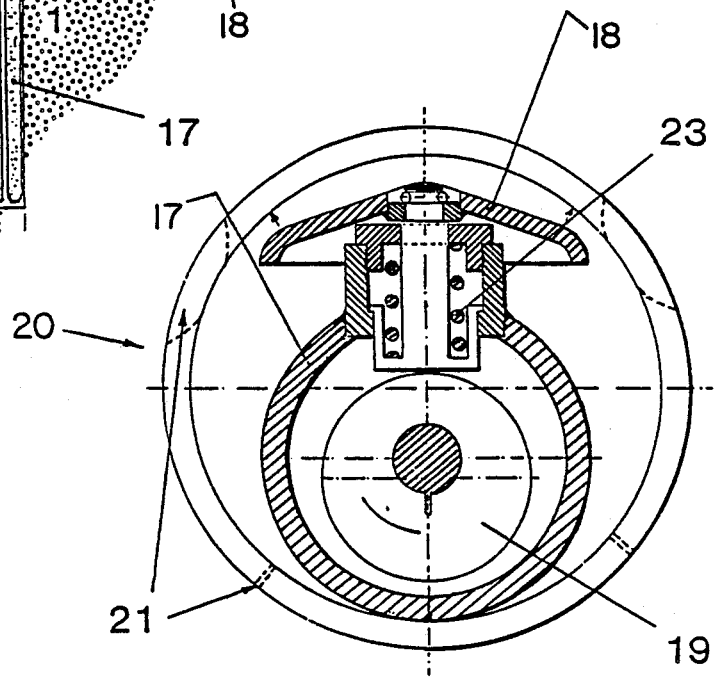

The tubular members 13 are aligned at the same time as the successive GEOSELLS are fitted since the GEOTOOL 20 shown in FIG. 5*a* and 5*b* provides for continuous centering at the same time as locking them into the lower part already fitted. These actions are exerted by the tubular body 17 and the expansion skid 18 providing for centering on the interface and fixed approximately one meter inside the structure 1 already in place. Expansion is achieved by 180° rotation of a shaft carrying two cams 19, a return spring system 23 making it possible to withdraw the tool after stabilization of the rubble, which has the effect of trapping the GEOSELL. Drainage slots 21 are formed by sawing and have a capacity calculated on the basis of the immense capacity of the tube 13. In the upper part of the GEOTOOL 20 a system of two screws 22 permits adjustment of the new GEOSELL when it is fitted in place. The holes 12 left in the flanges 11, as well as providing for various handling and hooking operations, make it possible to use plastics tubes for simple fixing of grids so-called "GEOGRIDS" in the case where rubble reinforced with GEOGRIDS is used. It may be necessary to use GEOGRIDS at the surface of any type of rubble to prevent any onset of cracking.

Figure 6A:
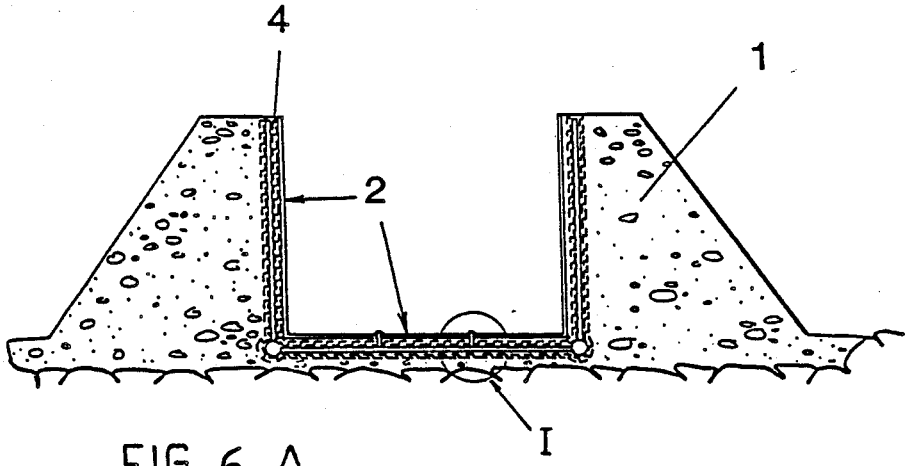
FIG. 6*a* is an application example showing a different application method in the case of a foundation slab applicable to tunnels and elsewhere (retaining or constructional walls, etc).
Figure 6B:
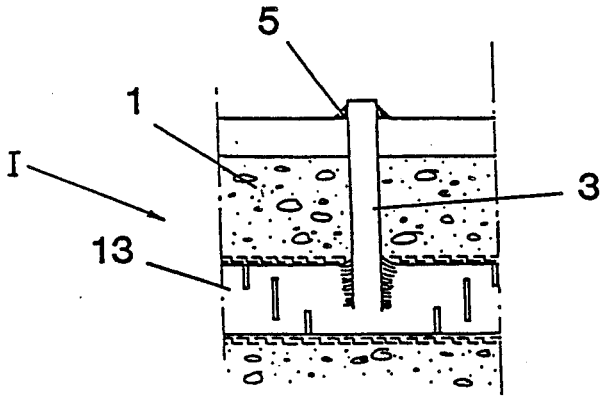
FIG. 6*b* is an enlarged view of the section labelled I in FIG. 6*a*.

As shown in FIGS. 6*a*and 6*b*, it is advantageous to reduce the footprint of a structure by using steeper slopes while leaving complete freedom to the sealed structure. Likewise, it is advantageous to utilize on flexible foundations a flexible rubble ("TEXSOL" or other rubble reinforced with GEOGRIDS), using a fixing tube and the holes in the flanges 11 instead of or in conjunction with a roller compacted concrete structure.

Further specific examples of the very large number of applications of the method in accordance with the invention are:

skating rink linings (with gas drainage);

internal lining of tunnels (drainage, continuous sealing, strickler (advantageous), elasticity to maintain watertightness, especially in poor soil, etc);

construction of earthquake-proof walls for houses or buildings, welded continuously and with lightweight filling (expanded polyurethane, lightweight concrete, etc);

retaining walls (finished appearance and drainage);

construction of swimming pools with tiled finish factory applied hot to the GEOSELLS (integrated into the GEOSELLS); and refurbishing the sides of dams in contact with the water.

There is claimed:

1. Method of rendering waterproof a hydraulic structure comprising the steps of:

forming an impermeable membrane from a staggered series of worked and assembled thick plastics material with scales, by interlocking said staggered series with each other and welding together said staggered series in a continuous way;

attaching a material layer to one side of said membrane; and fixing vertical fixings to the one side of said membrane adapted to connect said membrane to said structure, wherein said membrane and said structure are separated from one another by said material layer enabling movement of said scales and initiating microfissures spread regularly through said structure.

2. Method according to claim 1, wherein said staggered series are between one and fifty millimeters thick.

3. Method according to claim 2, wherein said staggered series are between two and thirty millimeters thick.

4. Method according to claim 1, wherein said step of interlocking said staggered series comprises the step of welding said scales of said staggered series together on the inside, meaning the side facing said structure, on a thick support.

5. Method according to claim 1, wherein said staggered series are made from a material that is resistant to fatigue and said step of welding said staggered series comprises the step of welding said staggered series by a high-frequency process which heats an inclusion.

6. Method according to claim 5, wherein said material is a polyolefin of high elastic strength.

7. Method according to claim 5, wherein said inclusion is made of metal.

8. Method according to claim 5, wherein said inclusion is made of polyvinyl chloride.

9. Method according to claim 1, wherein said material separating said membrane from said structure is a thick, continuous drainage system comprising a geotextile.

10. Method according to claim 1, further comprising the step of fixing said membrane horizontally by at least one lug welded horizontally to the top of each staggered series, embedded in said structure and functioning in relative shear.

11. Method according to claim 1, wherein said step of fixing said membrane vertically comprises the steps of fixing orthogonal fixing strips vertically to the side of said staggered series facing said structure and fixing tubular drainage members to said fixing strips, said tubular drainage members adapted to extend into said structure to connect said membrane to said structure.

12. Method according to claim 1, wherein said step of fixing said membrane vertically comprises the step of fixing said membrane by means of tools which expand to lock, center and adjust the staggered series to be fitted at each level.

13. Method according to claim 11, wherein a tube is provided at the level of said fixing strip to enable the injection of an area featuring defects, said tubular drainage members being protected from such injection by a geotextile bonded to said fixing strip.

14. Method according to claim 11, wherein said tubular members are covered with geotextile and a respective member with a cutting edge is disposed over each of said tubular members.

15. Method according to claim 1, wherein the side of said membrane adapted to be in contact with the water receives a surface coating.

16. Method according to claim 15, wherein said coating is resin cement.

17. Method according to claim 17, wherein said coating comprises grit applied at a raised temperature.

18. Method according to claim 15, wherein said coating is tiles.

19. Method according to claim 15, wherein said coating is wood.

20. Method according to claim 1, further comprising the step of applying said staggered series in successive strata as said structure is built and serve as non-reusable shuttering, entailing the use of tools.

21. Method according to claim 1, further comprising the step of, within foundation slabs walls or tunnels of the structure, fixing said staggered series by continuous drainage tubes in a horizontal or curved arrangement, without entailing the use of tools.

22. Method according to claim 21, wherein said binder is a resin.

23. Method according to claim 21, wherein said binder is a textile.

24. Method according to claim 21, wherein said rubble is reinforced by grids.

25. Method according to claim 1, wherein within foundation slabs, walls or tunnels of the structure said staggered series are fixed by continuous drainage tubes in a horizontal or curved arrangement, without entailing the use of tools.

26. Method according to claim 25, further comprising the steps of welding said tubes so as to be continuous on the outside of said structure, that is to say on the side thereof adapted to be in contact with the water, on a thick support with a cold-smoothed surface.

* * * * *